United States Patent [19]

Rule et al.

[11] 4,127,412

[45] Nov. 28, 1978

[54] PHOTOCONDUCTIVE COMPOSITIONS AND ELEMENTS

[75] Inventors: Norman G. Rule, Rochester; Martin A. Berwick, Kendall; Lawrence E. Contois, Webster, all of N.Y.

[73] Assignee: Eastman Kodak Company, Rochester, N.Y.

[21] Appl. No.: 841,270

[22] Filed: Oct. 12, 1977

Related U.S. Application Data

[63] Continuation-in-part of Ser. No. 639,040, Dec. 9, 1975, abandoned, which is a continuation-in-part of Ser. No. 534,953, Dec. 20, 1976, abandoned.

[51] Int. Cl.[2] ..... G03G 5/06; G03G 13/22

[52] U.S. Cl. ..... 96/1 PC; 96/1.5 R; 96/1.6

[58] Field of Search ..... 96/1.5 R, 1.6, 1 PC; 252/501

[56] References Cited

U.S. PATENT DOCUMENTS

| | | | |
|---|---|---|---|
| 3,140,948 | 7/1964 | Stewart et al. | 96/1.5 R X |
| 3,542,544 | 11/1970 | Seus et al. | 96/1.5 R |
| 3,542,547 | 11/1970 | Wilson | 96/1.6 |
| 3,615,396 | 10/1971 | Gramza et al. | 96/1.6 |
| 3,615,402 | 10/1971 | Rule | 96/1.6 X |
| 3,615,414 | 10/1971 | Light | 96/1.6 |
| 3,627,525 | 12/1971 | Looker et al. | 96/1.5 R |
| 3,820,989 | 6/1974 | Rule et al. | 96/1.5 R |
| 3,963,779 | 6/1976 | Tsukahara et al. | 96/1.5 R |

FOREIGN PATENT DOCUMENTS

| | | | |
|---|---|---|---|
| 1,141,666 | 1/1969 | United Kingdom | 96/1.5 |

*Primary Examiner*—Roland E. Martin, Jr.
*Attorney, Agent, or Firm*—John R. Everett

[57] ABSTRACT

An organic photoconductive insulating composition and electrophotographic elements containing the same are prepared using as a photoconductor a polyarylalkane compound having the formula

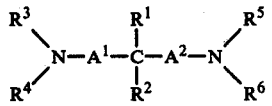

wherein $R^1$ and $R^2$ represent hydrogen, alkyl, or aryl groups, $R^3$, $R^4$, $R^5$ and $R^6$ represent aryl groups, and $A^1$ and $A^2$ represent phenyl groups.

19 Claims, No Drawings

PHOTOCONDUCTIVE COMPOSITIONS AND ELEMENTS

This application is a continuation-in-part of Rule et al., U.S. Ser. No. 639,040 filed Dec. 9, 1975, now abandoned, which is in turn a continuation-in-part of Rule et al., U.S. Ser. No. 534,953 filed Dec. 20, 1974, now abandoned.

FIELD OF THE INVENTION

This invention relates to electrophotography and in particular to photoconductive insulating compositions and elements.

DESCRIPTION OF THE PRIOR ART

The process of xerography, as disclosed by Carlson in U.S. Pat. No. 2,297,691, employs an electrophotographic element comprising a support material bearing a coating of an insulating material whose electrical resistance varies with the amount of incident electromagnetic radiation it receives during an imagewise exposure. The element, commonly termed a photoconductive element, is first given a uniform surface charge, generally in the dark after a suitable period of dark adaptation. It is then exposed to a pattern of actinic radiation which has the effect of differentially reducing the potential of this surface charge in accordance with the relative energy contained in various parts of the radiation pattern. The differential surface charge or electrostatic latent image remaining on the electrophotographic element is then made visible by contacting the surface with a suitable electroscopic marking material. Such marking material or toner, whether contained in an insulating liquid or on a dry carrier, can be deposited on the exposed surface in accordance with either the charge pattern or discharge pattern as desired. Deposited marking material can then be either permanently fixed to the surface of the sensitive element by known means such as heat, pressure, solvent vapor or the like, or transferred to a second element to which it can similarly be fixed. Likewise, the electrostatic charge pattern can be transferred to a second element and developed there.

Various photoconductive insulating materials have been employed in the manufacture of electrophotographic elements. For example, vapors of selenium and vapors of selenium alloys deopsited on a suitable support and particles of photoconductive zinc oxide held in a resinous, film-forming binder have found wide application in present-day document copying processes.

Since the introduction of electrophotography, a great many organic compounds have also been screened for their photo-conductive properties. As a result, a very large number of organic compounds have been known to possess some degree of photoconductivity. Many organic compounds have revealed a useful level of photoconduction and have been incorporated into photoconductive compositions. Among these organic photo-conductors are certain of the triphenylamines as described in U.S. Pat. No. 3,180,730 issued Apr. 27, 1965, and the polyarylalkane compounds such as those described in U.S. Pat. No. 3,274,000 issued Sept. 20, 1966; U.S. Pat. No. 3,542,547 issued November 24, 1970; U.S. Pat. No. 3,542,544 issued November 24, 1974; and in Rule, U.S. Pat. No. 3,615,402 issued October 26, 1971 and Rule, U.S. Pat. No. 3,820,989 issued June 28, 1974.

Optically clear organic photoconductor-containing elements having desirable electrophotographic properties can be especially useful in electrophotography. Such electrophotographic elements can be exposed through a transparent base if desired, thereby providing flexibility in equipment design. Such compositions, when coated as a film or layer on a suitable support, also yield an element which is reusable; that is, it can be used to form subsequent images after residual toner from prior images has been removed by transfer and/or cleaning. Thus far, the selection of various compounds for incorporation into photoconductive compositions to form electrophotographic layers has generally proceeded on an empirical compound-by-compound selection basis.

A high speed "heterogeneous" or "aggregate" multiphase photoconductive system was developed by William A. Light which overcomes many of the problems of the prior art. This aggregate photoconductive composition (as it is referred to hereinafter) is the subject matter of U.S. Pat. No. 3,615,414 issued Oct. 26, 1971. The addenda disclosed therein are responsible for the exhibition of desirable electrophotographic properties in photoconductive elements prepared therewith. In particular, they have been found to enhance the speed of many organic photoconductors when used therewith. The degree of such enhancement is, however, variable, depending on the particular organic photoconductor so used.

SUMMARY OF THE INVENTION

In accord with the present invention there is provided an organic, photoconductive insulating composition comprising a polyarylalkane compound having the formula

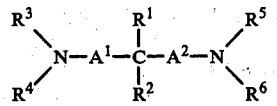

I.

wherein $R^1$ and $R^2$, which may be the same or different, represent, when taken separately, hydrogen and alkyl groups, including substituted alkyl groups, and when taken together, represent the saturated carbon atoms necessary to complete a cycloalkyl group; $R^3$, $R^4$, $R^5$ and $R^6$, which may be the same or different, each represent an aryl group, including a substituted aryl group; and $A^1$ and $A^2$, which may be the same or different, represent phenyl groups, including substituted phenyl groups.

In accord with an especially useful embodiment of the present invention organic photoconductive insulating compositions are provided exhibiting unexpected increases in thermal stability. This highly beneficial result is obtained by incorporating in such photoconductive compositions one or more polyarylalkane compounds having formula I above and which possess a glass transition temperature, i.e., Tg, in excess of 50° C.

In accord with one embodiment of the present invention, it has been discovered that one or more of the polyarylalkane compounds of formula I may be employed as an organic photoconductor in the continuous polymer phase of a multiphase aggregate photoconductive composition of the type referred to hereinabove to extend the white light speed and thermal stability of the aggregate photoconductive composition.

In accord with another embodiment of the invention, it has been found that one or more of the polyarylalkane compounds of formula I may be employed as an organic photoconductor in a "non-aggregate-containing" organic photoconductive insulating composition, for example, a homogeneous organic photoconductive composition comprising a solid solution of one or more of the polyarylalkane compounds of formula I and a polymeric binder.

Various polyarylalkane compounds having a chemical structure somewhat related to, but not idential to, those described above in formula I have been disclosed in the prior art as useful in organic photoconductive compositions. Representative of such prior art materials are compounds such as those disclosed in U.S. Pat. No. 3,542,547; U.S. Pat. No. 3,615,402; and U.S. Pat. No. 3,820,989. Other non-polyarylalkane classes of compounds somewhat similar to, but less closely related to, the polyarylalkane compounds of formula I above than the polyarylalkane compounds shown in U.S. Pat. No. 3,542,547, have also been described in the prior art as useful in organic photoconductive compositions. See, for example, the compounds shown in Canadian Pat. No. 914,699 issued Nov. 14, 1972 and U.S. Pat. No. 3,387,973, issued June 11, 1968.

According to the present invention, it has been found that the photoconductors described herein have substantially improved electrical speed over those related photoconductors described in U.S. Pat. No. 3,542,547. In addition, it has been found that the photoconductors of the present invention enhance the thermal stability of organic photoconductive compositions in comparison to those related photoconductors described in Canadian Pat. No. 914,699 and U.S. Pat. Nos. 3,615,402 and 3,820,989.

Small amounts of other polyarylalkane compounds structurally similar to those described above in formula I, for example, 4,4'-tetramethyldiaminodiphenylmethane, have been described in the prior art, e.g., in British Pat. No. 1,141,666 dated Jan. 29, 1969, as chemical activators or sensitizers for zinc oxide photoconductive compositions. However, there is no teaching or suggestion in British Pat. No. 1,141,666 that compounds having formula I above are useful as organic photoconductors in an organic photoconductive composition, i.e. a photoconductive composition free from all inorganic photoconductors such as zinc oxide. Moreover, it has been found that the organic photoconductive compositions of the present invention which contain the organic photoconductive compounds of formula I above exhibit enhanced thermal stability in comparison to that which would be obtained in the organic photoconductive composition if the "zinc-oxide-sensitizer" compound of British Patent 1,141,666, i.e., 4,4'-tetramethyldiaminodiphenylmethane, were substituted for the organic photoconductive compounds used in the present invention.

DESCRIPTION OF THE PREFERRED EMBODIMENTS

The preferred photoconductors of the invention may be characterized by the following formula:

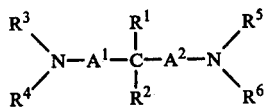

I.

wherein $R^1$ and $R^2$, which can be the same or different, represent, when taken separately, hydrogen or alkyl, including substituted alkyl and, when taken together, $R^1$ and $R^2$ represent the saturated carbon atoms necessary to complete a substituted or unsubstituted cycloalkyl group having from 3 to 10, preferably from 5 to 7 carbon atoms in the cycloalkyl ring;

$R^3$, $R^4$, $R^5$ and $R^6$, which can be the same or different, each represent an unsubstituted or substituted aryl group having a substituent selected from the group consisting of alkyloxy, aryloxy, amino, hydroxy, alkylamino, arylamino, nitro, cyano, halogen, alkyl and acyl; and $A^1$ and $A^2$, which may be the same or different, represent an unsubstituted or substituted phenyl group having the substituents defined for $R^3$, $R^4$, $R^5$ and $R^6$ above.

Typically $R^1$, $R^2$, $R^3$, $R^4$, $R^5$ and $R^6$ represent an alkyl group having 1 to 18 carbon atoms e.g., methyl, ethyl, propyl, butyl, isobutyl, octyl, dodecyl, etc. including a substituted alkyl group having 1 to 18 carbon atoms such as a. alkoxyalkyl, e.g., ethoxypropyl, methoxybutyl, propoxymethyl, etc.,
b. aryloxyalkyl, e.g., phenoxyethyl, naphthoxymethyl, phenoxypentyl, etc.,
c. aminoalkyl, e.g., aminobutyl, aminoethyl, aminopropyl, etc.,
d. hydroxyalkyl e.g., hydroxypropyl, hydroxyoctyl, etc.,
e. aralkyl e.g., benzyl, phenethyl, etc.
f. alkylaminoalkyl e.g., methylaminopropyl, methylaminoethyl, etc., and also including dialkylaminoalkyl e.g., diethylaminoethyl, dimethylaminopropyl, propylaminooctyl, etc.,
g. arylaminoalkyl, e.g., phenylaminoalkyl, diphenylaminoalkyl, N-phenyl-N-ethylaminopentyl, N-phenyl-N-ethylaminohexyl, naphthylaminomethyl, etc.,
h. nitroalkyl, e.g., nitrobutyl, nitroethyl, nitropentyl, etc.,
i. cyanoalkyl, e.g., cyanopropyl, cyanobutyl, cyanoethyl, etc., and
j. haloalkyl, e.g., chloromethyl, bromopentyl, chlorooctyl, etc.,
k. alkyl substituted with an acyl group having the formula

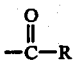

wherein R is hydroxy, hydrogen, aryl, e.g., phenyl, naphthyl, etc., lower alkyl having one to eight carbon atoms e.g., methyl, ethyl, propyl, etc., amino including substituted amino, e.g., diloweralkylamino, lower alkoxy having one to eight carbon atoms, e.g., butoxy, methoxy, etc., aryloxy, e.g., phenoxy, naphthoxy, etc.

Typically $R^3$, $R^4$, $R^5$ and $R^6$ represent an aryl group, e.g., phenyl, naphthyl, anthryl, fluorenyl, etc., including a substituted aryl group such as a. alkoxyaryl, e.g., ethoxyphenyl, methoxyphenyl, propoxynaphthyl, etc.
b. aryloxyaryl, e.g., phenoxyphenyl, naphthoxyphenyl, phenoxynaphthyl, etc.

c. aminoaryl, e.g. aminophenyl, aminonaphthyl, aminoanthryl, etc.
d. hydroxyaryl, e.g., hydroxyphenyl, hydroxynaphthyl, hydroxyanthryl, etc.
e. biphenylyl,
f. alkylaminoaryl, e.g., methylaminophenyl, methylaminonaphthyl, etc. and also including dialkylaminoaryl, e.g., diethylaminophenyl, dipropylaminophenyl, etc.
g. arylaminoaryl, e.g., phenylaminophenyl, diphenylaminophenyl, N-phenyl-N-ethylaminophenyl, naphthylaminophenyl, etc.
h. nitroaryl e.g., nitrophenyl, nitronaphthyl, nitroanthryl, etc.,
i. cyanoaryl, e.g., cyanophenyl, cyanonaphthyl, cyanoanthryl, etc.,
j. haloaryl, e.g., chlorophenyl, bromophenyl, chloronaphthyl, etc.,
k. alkaryl, e.g., tolyl, ethylphenyl, propylnaphthyl, etc., and
l. aryl substituted with an acyl group having the formula

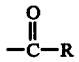

wherein R is hydroxy, hydrogen, aryl, e.g., phenyl, naphthyl, etc., amino including substituted amino, e.g., diloweralkylamino, lower alkoxy having one to eight carbon atoms, e.g., butoxy, methoxy, etc., aryloxy, e.g., phenoxy, naphthoxy, etc., lower alkyl having 1 to 8 carbon atoms, e.g., methyl, ethyl, propyl, butyl, etc.

In general, $A^1$ and $A^2$ are unsubstituted when both $R^1$ and $R^2$ represent substituents other than hydrogen.

In the case where $R^1$ and $R^2$ are taken together to form a substituted cycloalkyl, representative substituents which can be present on the cycloalkyl ring include linear or branched chain aliphatic groups having 1 to 10, preferably 1 to 4, carbon atoms. Typical of such aliphatic group substituents are those aliphatic groups having 1 to 10, preferably 1 to 4, carbon atoms included in the class of substituted and unsubstituted alkyl groups listed hereinabove for $R^1$ and $R^2$.

Typical compounds which belong to the general class of photoconductive compounds described herein include the following materials listed in Table 1 below:

TABLE 1

(I) 1,1-Bis(4-di-p-tolylaminophenyl)cyclohexane having the formula

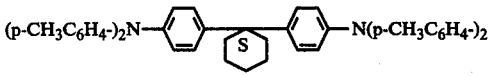

(II) 2,2-Bis(di-p-tolylaminophenyl)propane having the formula

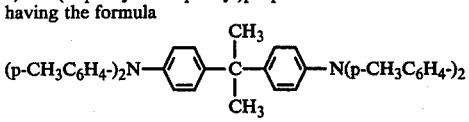

(III) 4,4'-Bis(di-p-tolylamino)-1,1,1-triphenylethane having the formula

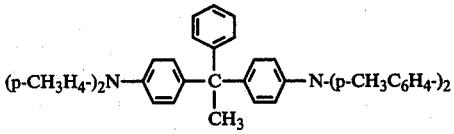

(IV) 4,4'-Bis(di-p-tolylamino)tetraphenylmethane having the formula

TABLE 1-continued

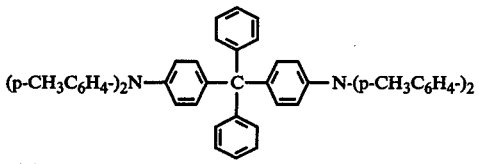

(V) Bis(4-di-p-tolylaminophenyl)methane having the formula

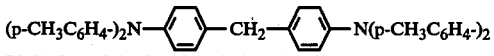

(VI) Bis(4-di-p-tolylaminophenyl)phenylmethane having the formula

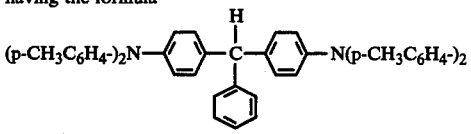

(VII) 1,1-Bis(4-di-p-tolylaminophenyl)-4-t-butylcyclohexane having the formula

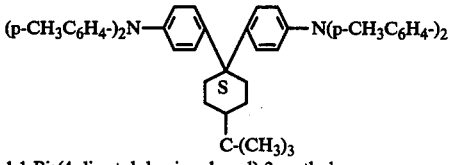

(VIII) 1,1-Bis(4-di-p-tolylaminophenyl)-2-methylpropane having the formula

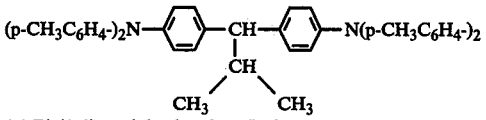

(IX) 1,1-Bis(4-di-p-tolylaminophenyl)ethane having the formula

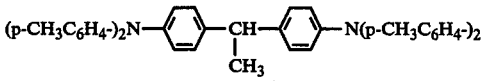

(X) 1,1-Bis(4-di-p-tolylaminophenyl)-3-methylbutane having the formula

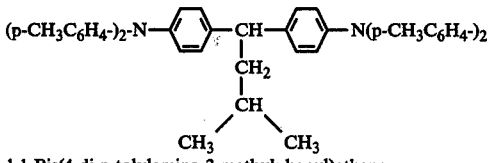

(XI) 1,1-Bis(4-di-p-tolylamino-2-methylphenyl)ethane having the formula

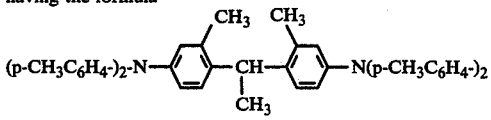

Compounds which belong to the general class of photoconductive compounds described herein and which are preferred for use in accord with the present invention include those compounds having the structural formula shown above wherein $A^1$ and $A^2$ are unsubstituted phenyl groups and at least one of $R^1$ or $R^2$ represent a group other than hydrogen, preferably $R^1$ and $R^2$, taken together, represent the necessary saturated carbon atoms to complete a 6-member cycloalkyl ring. These compounds are preferred because of the high electrical speeds and significantly increased thermal stability which is obtained from organic photoconductive compositions containing the same.

Compounds which belong to the general class of photoconductive compounds described herein and which are especially preferred for use in accord with the present invention include those compounds having the structural formula shown above wherein $A^1$ and $A^2$ are unsubstituted phenyl groups; $R^1$ and $R^2$ represent the necessary saturated carbon atoms to complete a 6-member cycloalkyl ring; and $R^3$, $R^4$, $R^5$ and $R^6$ are unsubstituted phenyl radicals or alkyl substituted phenyl radicals having no more than two alkyl substituents, said alkyl substituents containing 1 or 2 carbon atoms. These compounds are preferred because of their generally increased thermal stability and because of the high electrical speeds which are obtained from organic photoconductive compositions, particularly aggregate photoconductive compositions, which contain these compounds.

The photoconductive insulating compositions used in the photoconductive elements of the present invention are essentially organic material-containing compositions free from all inorganic photoconductors, i.e., photoconductors such as zinc oxide composed solely of inorganic molecules. The term "organic", as used herein, refers to both organic and metalloorganic materials.

As noted above, aggregate photoconductive insulating compositions used in this invention comprise an organic sensitizing dye and a polymeric material such as an electrically insulating, film-forming polymeric material. They may be prepared by several techniques, such as, for example, the so-called "dye first" technique described in Gramza et al. U.S. Pat. No. 3,615,396 issued Oct. 26, 1971. Alternatively, they may be prepared by the so-called "shearing" method described in Gramza, U.S. Pat. No. 3,615,415 issued Oct. 26, 1971. This latter method involves the high speed shearing of the photoconductive composition prior to coating and thus eliminates subsequent solvent treatment, as was disclosed in Light, U.S. Pat. No. 3,615,414 referred to above. By whatever method prepared, the aggregate composition is combined with the photoconductive composition of the invention in a suitable solvent to form a photoconductor-containing composition which is coated on a suitable support to form a separately identifiable multiphase composition, the heterogeneous nature of which is generally apparent when viewed under magnification, although such compositions may appear to be substantially optically clear to the naked eye in the absence of magnification. There can, of course, be macroscopic hetergeneity. Suitably, the dye-containing aggregate in the discontinuous phase is predominantly in the size range of from about 0.01 to about 25 microns.

In general, the aggregate compositions formed as described herein are multiphase organic solids containing dye and polymer. The polymer forms an amorphous matrix or continuous phase which contains a discrete discontinuous phase as distinguished from a solution. The discontinuous phase is the aggregate species which is a co-crystalline complex comprised of dye and polymer.

The term co-crystalline complex as used herein has reference to a crystalline compound which contains dye and polymer molecules co-crystallized in a single crystalline structure to form a regular array of the molecules in a three-dimensional pattern.

Another feature characteristic of the aggregate compositions formed as described herein is that the wavelength of the radiation absorption maximum characteristic of such compositions is substantially shifted from the wavelength of the radiation absorption maximum of a substantially homogeneous dye-polymer solid solution formed of similar constituents. The new absorption maximum characteristic of the aggregates formed by this method is not necessarily an overall maximum for this system as this will depend upon the relative amount of dye in the aggregate. Such an absorption maximum shift in the formation of aggregate systems for the present invention is generally of the magnitude of at least about 10 nm. If mixtures of dyes are used, one dye may cause an absorption maximum shift to a longer wavelength and another dye cause an absorption maximum shift to a shorter wavelength. In such cases, a formation of the aggregate compositions can more easily be identified by viewing under magnification.

Sensitizing dyes and electrically insulating polymeric materials are used in forming these aggregate compositions. Typically, pyrylium dyes, including pyrylium, bispyrylium, thiapyrylium and selenapyrylium dye salts and also salts of pyrylium compounds containing condensed ring systems such as salts of benzopyrylium and naphthopyrylium dyes are useful in forming such compositions. Dyes from these classes which may be useful are disclosed in Light U.S. Pat. No. 3,615,414.

Particularly useful dyes in forming the feature aggregates are pyrylium dye salts having the formula:

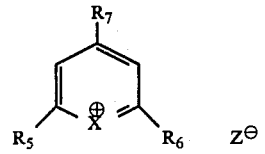

wherein:

$R_5$ and $R_6$ can each be phenyl groups, including substituted phenyl groups having at least one substituent chosen from alkyl groups of from 1 to about 6 carbon atoms and alkoxy groups having from 1 to about 6 carbon atoms;

$R_7$ can be an alkylamino-substituted phenyl group having from 1 to 6 carbon atoms in the alkyl group, and including dialkylamino-substituted and haloalkylamino-substituted phenyl groups;

X can be an oxygen, selenium or a sulfur atom; and $Z^{\ominus}$ is an anion.

The polymers useful in forming the aggregate compositions include a variety of materials. Particularly useful are electrically insulating, film-forming polymers having an alkylidene diarylene group in a recurring unit such as those linear polymers, including copolymers, containing the following group in a recurring unit:

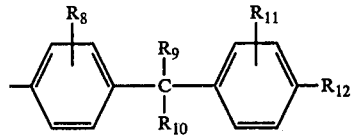

wherein:

$R_9$ and $R_{10}$, when taken separately, can each be a hydrogen atom, an alkyl group having from one to about 10 carbon atoms such as methyl, ethyl, isobutyl, hexyl, heptyl, octyl, nonyl, decyl, and the like including substituted alkyl groups such as trifluoromethyl, etc., and an aryl group such as phenyl and naphthyl, including substituted aryl groups having such substituents as a halogen atom, an alkyl group of from 1 to about 5 carbon atoms, etc.; and $R_9$ and $R_{10}$, when taken together, can represent the carbon atoms necessary to complete a saturated cyclic hydrocarbon group including cycloalkanes such as cyclohexyl and polycycloalkanes such as norbornyl, the total number of carbon atoms in $R_9$ and $R_{10}$ being up to about 19;

$R_8$ and $R_{11}$ can each be hydrogen, an alkyl group of from 1 to about 5 carbon atoms, e.g., or a halogen such as chloro, bromo, iodo, etc.; and $R_{12}$ is a divalent group selected from the following:

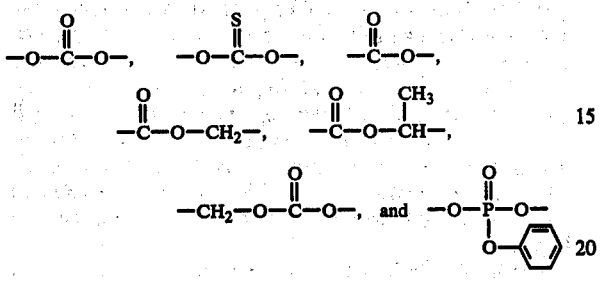

Preferred polymers useful for forming aggregate crystals are hydrophobic carbonate polymers containing the following group in a recurring unit:

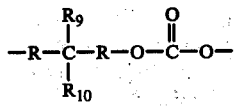

wherein:

each R is a phenylene group including halo substituted phenylene groups and alkyl substituted phenylene groups; and $R_9$ and $R_{10}$ are described above. Such compositions are disclosed, for example in U.S. Pat. Nos. 3,028,365 and 3,317,466. Preferably polycarbonates containing an alkylidene diarylene group in the recurring unit such as those prepared with Bisphenol A and including polymeric products of ester exchange between diphenylcarbonate and 2,2-bis-(4-hydroxyphenyl)propane are useful in the practice of this invention. Such compositions are disclosed in the following U.S. Patents: U.S. Pat. No. 2,999,750 by Miller et al, issued Sept. 12, 1961; 3,038,874 by Laakso et al, issued June 12, 1962; 3,038,879 by Laakso et al, issued June 12, 1962; 3,038,880 by Laakso et al, issued June 12, 1962; 3,106,544 by Laakso et al, issued Oct. 8, 1963; 3,106,545 by Laakso et al, issued Oct. 8, 1963; and 3,106,546 by Laakso et al, issued Oct. 8, 1963. A wide range of film-forming polycarbonate resins are useful, with completely satisfactory results being obtained when using commercial polymeric materials which are characterized by an inherent viscosity of about 0.5 to about 1.8.

The following polymers are included among the materials useful in the practice of this invention:

TABLE 2

| No. | Polymeric Material |
|---|---|
| 1 | poly(4,4'-isopropylidenediphenylene-co-1,4-cyclohexylenedimethylene carbonate) |
| 2 | poly(ethylenedioxy-3,3'-phenylene thiocarbonate) |
| 3 | poly(4,4'-isopropylidenediphenylene carbonate-co-terephthalate) |
| 4 | poly(4,4'-isopropylidenediphenylene carbonate) |
| 5 | poly(4,4'-isopropylidenediphenylene thiocarbonate) |

TABLE 2-continued

| No. | Polymeric Material |
|---|---|
| 6 | poly(4,4'-sec-butylidenediphenylene carbonate) |
| 7 | poly(4,4'-isopropylidenediphenylene carbonate-block-oxyethylene) |
| 8 | poly(4,4'-isopropylidenediphenylene carbonate-block-oxytetramethylene) |
| 9 | poly[4,4'-isopropylidenebis(2-methylphenylene)-carbonate] |
| 10 | poly(4,4'-isopropylidenediphenylene-co-1,4-phenylene carbonate) |
| 11 | poly(4,4'-isopropylidenediphenylene-co-2,3-phenylene carbonate) |
| 12 | poly(4,4'-isopropylidenediphenylene-co-4,4'-diphenylene carbonate) |
| 13 | poly(4,4'-isopropylidenediphenylene-co-4,4'-oxydiphenylene carbonate) |
| 14 | poly(4,4'-isopropylidenediphenylene-co-4,4'-carbonylidiphenylene carbonate) |
| 15 | poly(4,4'-isopropylidenediphenylene-co-4,4'-ethylenediphenylene carbonate) |
| 16 | poly[4,4'-methylenebis(2-methylphenylene)carbonate] |
| 17 | poly[1,1-(p-bromophenylethylidene)bis(1,4-phenylene)carbonate] |
| 18 | poly[4,4'-isopropylidenediphenylene-co-4,4'-sulfonylidiphenylene)carbonate] |
| 19 | poly[4,4'-cyclohexylidene(4-diphenylene) carbonate] |
| 20 | poly[4,4'-isipropylidenebis(2-chlorophenylene)carbonate] |
| 21 | poly(4,4'-hexafluoroisopropylidenediphenylene carbonate) |
| 22 | poly(4,4'-isopropylidenediphenylene 4,4'-isopropylidenedibenzoate) |
| 23 | poly(4,4'-isopropylidenedibenzyl 4,4'-isopropylidenedibenzoate) |
| 24 | poly[4,4'-(1,2-dimethylpropylidene)diphenylene carbonate] |
| 25 | poly[4,4'-(1,2,2-trimethylpropylidene)-diphenylene carbonate] |
| 26 | poly{4,4'-[1-(α-naphthyl)ethylidene]-diphenylene carbonate} |
| 27 | poly[4,4'-(1,3-dimethylbutylidene)-diphenylene carbonate] |
| 28 | [4,4'-(2-norbornylidene)diphenylene carbonate] |
| 29 | poly[4,4'-(hexahydro-4,7-methanoindan-5-ylidene) diphenylene carbonate] |

Electrophotographic elements of the invention containing the above-described aggregate photoconductive composition can be prepared by blending a dispersion or solution of the photoconductive composition together with a binder, when necessary or desirable, and coating or forming a self-supporting layer with the materials. Supplemental materials useful for changing the spectral sensitivity or electrophotosensitivity of the element can be added to the composition of the element when it is desirable to produce the characteristic effect of such materials. If desired, other polymers can be incorporated in the vehicle, for example, to alter physical properties such as adhesion of the photoconductive layer to the support and the like. Techniques for the preparation of aggregate photoconductive layers containing such additional vehicles are described in C. L. Stephens, U.S. Pat. No. 3,679,407, issued July 25, 1972, and entitled *METHOD OF FORMING HETEROGENEOUS PHOTOCONDUCTIVE COMPOSITIONS AND ELEMENTS.* The photoconductive layers of the invention can also be sensitized by the addition of effective amounts of sensitizing compounds to exhibit improved electrophotosensitivity.

The amount of the polyarylalkane compounds described herein incorporated into the aggregate photoconductive compositions and elements of the invention can be varied over a relatively wide range. When used in an aggregate photoconductive composition the polyarylalkane compounds described herein or a mixture thereof should be in the continuous phase of the aggregate composition and may be present in an amount within the range of from about 1.0 to about 60.0 percent by weight, preferably from about 5.0 to about 40.0 percent by weight, (based on the dry weight of the aggregate photoconductive composition). Larger or smaller amounts of the polyarylalkane compound may also be employed in aggregate photoconductive compositions although best results are generally obtained when using an amount within the aforementioned preferred range.

In addition to electrographic elements containing the above-described aggregate photoconductive insulating compositions there are other useful embodiments of the present invention. For example, "non-aggregate-containing" electrographic elements can be prepared with the photoconductive compounds of the invention in the usual manner, i.e., by blending a dispersion or solution of a photoconductive compound together with a binder, when necessary or desirable, and coating or forming a self-supporting layer with the photoconductor-containing materials. Likewise, other organic photoconductors known in the art can be combined with the present photoconductors. In addition, supplemental materials useful for changing the spectral sensitivity or electrophotosensitivity of the element can be added to the composition of the element when it is desirable to produce the characteristic effect of such materials.

The non-aggregate, organic photoconductive insulating layers of the invention such as homogeneous organic photoconductive compositions can be sensitized by the addition of effective amounts of sensitizing compounds to exhibit improved electrophotosensitivity. Sensitizing compounds useful with the photoconductive compounds of the present invention can be selected from a wide variety of materials, including such materials as pyrylium dye salts including thiapyrylium dye materials and selenapyrylium dye salts disclosed in VanAllan et al U.S. Pat. No. 3,250,615; fluorenes, such as 7,12-dioxo-13-dibenzo(a,h)fluorene, 5,10-dioxo-4a,11-diazobenzo(b)-fluorene, 3,13-dioxo-7-oxadibenzo(b,g)-fluorene, and the like; aromatic nitro compounds of the kinds described in U.S. Pat. No. 2,610,120; anthrones like those disclosed in U.S. Pat. No. 2,670,284; quinones, U.S. Pat. No. 2,670,286; benzophenones, U.S. Pat. No. 2,670,287; thiazoles, U.S. Pat. No. 3,732,301; mineral acids; carboxylic acids, such as maleic acid, dichloroacetic acid, trichloroacetic acid and salicylic acid, sulfonic and phosphoric acids, and various dyes, such as cyanine (including carbocyanine), merocyanine, diarylmethane, thiazine, azine, oxazine, xanthene, phthalein, acridine, azo, anthraquinone dyes and the like and mixtures thereof. The sensitizers preferred for use with the compounds of this invention are selected from pyrylium salts including selenapyrylium salts and thiapyrylium salts, and cyanine dyes including carbocyanine dyes.

Where a sensitizing compound is employed with the binder and organic photoconductor to form a sensitized, non-aggregate containing organic photoconductive composition, it is the normal practice to mix a suitable amount of the sensitizing compound with the coating composition so that, after thorough mixing, the sensitizing compound is uniformly distributed in the coated layer.

Other methods of incorporating the sensitizer or the effect of the sensitizer may, however, be employed consistent with the practice of this invention. In preparing the non-aggregate organic photoconductive layers, no sensitizing compound is required to give photoconductivity in the layers which contain the photoconducting substances with respect to ultraviolet radiation sources; therefore, a sensitizer may not be required in a particular photoconductive layer of the invention depending upon the particular radiation source selected. However, since relatively minor amounts of sensitizer are effective in (a) producing a layer exhibiting photoconductivity with respect to visible light and (b) substantially increasing the electrical speed of the layer, the use of a sensitizer is generally preferred. The amount of sensitizer that can be added to a photoconductor-incorporating layer to give effective increases in speed can vary widely. The optimum concentration in any given case will vary with the specific photoconductor and sensitizing compound used. In general, substantial speed gains can be obtained where an appropriate sensitizer is added in a concentration range from about 0.001 to about 30 percent by weight based on the weight of the film-forming coating composition, with an amount of from about 0.005 to about 10 percent by weight being typical.

Preferred binders for use in preparing the present non-aggregate organic photoconductive layers are film-forming, hydrophobic polymeric binders having fairly high dielectric strength and good electrical insulating properties.

Typical of these materials are:

I. Natural resins including gelatin, cellulose ester derivatives such as alkyl esters of carboxylated cellulose, hydroxy ethyl cellulose, carboxy methyl cellulose, carboxy methyl hydroxy ethyl cellulose, etc.;

II. Vinyl resins including
   a. polyvinyl esters such as a vinyl acetate resin, a copolymer of vinyl acetate and crotonic acid, a copolymer of vinyl acetate with an ester of vinyl alcohol and a higher aliphatic carboxylic acid such as lauric acid or stearic acid, polyvinyl stearate, a copolymer of vinyl acetate and maleic acid, a poly(vinylhaloarylate) such as poly(vinyl-m-bromobenzoate-covinyl acetate), a terpolymer of vinyl butyral with vinyl alcohol and vinyl acetate, etc.;
   b. Vinyl chloride and vinylidene chloride polymers such as a poly(vinylchloride), a copolymer of vinyl chloride and vinyl isobutyl ether, a copolymer of vinylidene chloride and acrylonitrile, a terpolymer of vinyl chloride, vinyl acetate and vinyl alcohol, poly(vinylidene chloride) a terpolymer of vinyl chloride, vinyl acetate and maleic anhydride, a copolymer of vinyl chloride and vinyl acetate, etc.;
   c. styrene polymers such as polystyrene, a nitrated polystyrene, a copolymer of styrene and monoisobutyl maleate, a copolymer of styrene with methacrylic acid, a copolymer of styrene and butadiene, a copolymer of dimethylitaconate and styrene, polymethylstyrene, etc.;
   d. methacrylic acid ester polymers such as a poly(alkylmethacrylate), etc.;
   e. polyolefins such as chlorinated polyethylene, chlorinated polypropylene, poly(isobutylene), etc.;
   f. poly(vinyl acetals) such as poly(vinyl butyral), etc.; and
   g. poly(vinyl alcohol);

III. Polycondensates including
   a. a polyester of 1,3-disulfobenzene and 2,2-bis(4-hydroxyphenyl)propane;

b. a polyester of diphenyl-p,p'-disulphonic acid and 2,2-bis(4-hydroxyphenyl)propane;
c. a polyester of 4,4'-dicarboxyphenyl ether and 2,2-bis(4-hydroxyphenyl)propane;
d. a polyester of 2,2-bis(4-hydroxyphenyl)propane and fumaric acid;
e. polyester of pentaerythritol and phthalic acid;
f. resinous terpene polybasic acid;
g. a polyester of phosphoric acid and hydroquinone;
h. polyphosphites;
i. polyester of neopentylglycol and isophthalic acid;
j. polycarbonates including polythiocarbonates such as the polycarbonate of 2,2-bis[4-hydroxyphenyl]propane;
k. polyester of isophthalic acid, 2,2-bis[4(β-hydroxyethoxy)phenyl]propane and ethylene glycol;
l. polyester of terephthalic acid, 2,2-bis[4(β-hydroxyethoxy)phenyl]propane and ethylene glycol;
m. polyester of ethylene glycol, neopentyl, glycol, terephthalic acid and isophthalic acid;
n. polyamides;
o. ketone resins; and
p. phenol-formaldehyde resins;

IV. Silicone resins;
V. Alkyd resins including styrene-alkyd resins, silicone-alkyd resins, soya-alkyd resins, etc.;
VI. Paraffin; and
VII. Mineral waxes.

Solvents useful for preparing coating compositions containing the photoconductors of the present invention can include a wide variety of organic solvents for the components of the coating composition.

Typical solvents include:

(1) Aromatic hydrocarbons such as benzene, naphthalene, etc., including substituted aromatic hydrocarbons such as toluene, xylene, mesitylene, etc.;
(2) Ketones such as acetone, 2-butanone, etc.;
(3) Halogenated aliphatic hydrocarbons such as methylene chloride, chloroform, ethylene chloride, etc.;
(4) Ethers including cyclic ethers such as tetrahydrofuran, ethyl ether;
(5) Mixtures of the above.

In preparing the non-aggregate-containing organic photoconductive coating compositions of the present invention useful results are obtained where the photoconductor is present in an amount equal to at least about 1.0 weight percent of the composition. Typically, when the polyarylalkane compound used in the present invention is a primary or the only photoconductor employed in the composition, the polyarylalkane compound is present in an amount equal to at least about 15 percent by weight based on the dry weight of the resultant photoconductive composition. The upper limit in the amount of photoconductive material present in the non-aggregate photoconductive composition of the invention can be widely varied to at least 90% by weight in accordance with usual practice.

Suitable supporting materials on which both the aggregate and non-aggregate photoconductive insulating layers of this invention can be coated include any of a wide variety of electrically conducting supports, for example, paper (at a relative humidity above 20 percent); aluminum-paper laminates; metal foils such as aluminum foil, zinc foil, etc.; metal plates, such as aluminum, copper, zinc, brass and galvanized plates; vapor deposited metal layers such as silver, nickel, aluminum and the like coated on paper or conventional photographic film bases such as cellulose acetate, polystyrene, etc. Such conducting materials as nickel can be vacuum deposited on transparent film supports in sufficiently thin layers to allow electrophotographic elements prepared therewith to be exposed from either side of such elements. An especially useful conducting support can be prepared by coating a support material such as poly(ethylene terephthalate) with a conducting layer containing a semiconductor dispersed in a resin. Such conducting layers both with and without insulating barrier layers are described in U.S. Pat. No. 3,245,833 by Trevoy, issued Apr. 12, 1966. Likewise, a suitable conducting coating can be prepared from the sodium salt of a carboxyester lactone of maleic anhydride and a vinyl acetate polymer. Such kinds of conducting layers and methods for their optimum preparation and use are disclosed in U.S. Pat. No. 3,007,901 by Minsk, issued Nov. 7, 1961 and 3,262,807 by Sterman et al, issued July 26, 1966.

Coating thicknesses of both the aggregate and non-aggregate photoconductive composition of the invention on a suitable support can vary widely. Normally, a coating in the range of about 10 microns to about 300 microns before drying is useful for the practice of this invention. The preferred range of coating thickness is found to be in the range from about 50 microns to about 150 microns before drying, although useful results can be obtained outside of this range. The resultant dry thickness of the coating is preferably between about 2 microns and about 50 microns, although useful results can be obtained with a dry coating thickness between about 1 and about 200 microns.

After the photoconductive elements prepared according to the present invention have been dried, they can be employed in any of the well-known electrophotographic processes which require photoconductive layers. One such process is the xerographic process. In a process of this type, an electrophotographic element is held in the dark and given a blanket electrostatic charge by placing it under a corona discharge. This uniform charge is retained by the layer because of the substantial dark insulating property of the layer, i.e., the low conductivity of the layer in the dark. The electrostatic charge formed on the surface of the photoconductive layer is then selectively dissipated from the surface of the layer by imagewise exposure to light by means of a conventional exposure operation such as, for example, by a contact printing technique, or by lens projection of an image, and the like, to thereby form a latent electrostatic image in the photoconductive layer. Exposing the surface in this manner forms a pattern of electrostatic charge by virtue of the fact that light energy striking the photoconductor causes the electrostatic charge in the light struck areas to be conducted away from the surface in proportion to the intensity of the illumination in a particular area.

The charge pattern produced by exposure is then developed or transferred to another surface and developed there, i.e., either the charged or uncharged areas rendered visible, by treatment with a medium comprising electrostatically-responsive particles having optical density. The developing electrostatically-responsive particles can be in the form of a dust, i.e., powder, or a pigment in a resinous binder, i.e., toner. A preferred method of applying such toner to a latent electrostatic image for solid area development is by the use of a magnetic brush. Methods of forming and using a magnetic brush, toner applicator are described in the following U.S. Pat. Nos. 2,786,439 by Young, issued Mar. 26, 1957; 2,786,440 by Giaimo, issued Mar. 26, 1957; U.S. Pat. Nos. 2,786,441 by Young, issued Mar. 26, 1957; 2,874,063 by Greig, issued February 17, 1959. Liquid development of the latent electrostatic image may also be used. In liquid development, the developing particles are carried to the image-bearing surface in an electrically insulating liquid carrier. Methods of development of this type are widely known and have been described in the patent literature, for example, U.S. Pat. No. 2,907,674 by Metcalfe et al, issued Oct. 6, 1959. In dry developing processes, the most widely used method of obtaining a permanent record is achieved by selecting a developing particle which has as one of its components a low-melting resin. Heating the powder image then causes the resin to melt or fuse into or on the element. The powder is, therefore, caused to adhere permanently to the surface of the photoconductive layer. In other cases, a transfer of the electrostatic charge image formed on the photoconductive layer can be made to a second support such as paper which would then become the final print after development and fusing. Techniques of the type indicated are well known in the art and have been described in the literature such as in "RCA Review" Vol. 15 (1954) pages 469–484.

The electrical resistivity of the photoconductive insulating element of the invention (as measured across the photoconductive insulating composition of the element in the absence of activating radiation for the composition) should be at least about $10^9$ ohm-cms. at 25° C. In general, it is advantageous to use elements having a resistivity several order of magnitude higher than $10^{10}$ ohm-cms., for example, elements having an electrical resistivity greater than about $10^{14}$ ohm-cms. at 25° C.

The polyarylalkane compounds of formula I described herein can, in general, be prepared by standard organic chemical synthetic procedures. Accordingly, extended description regarding the preparation of these polyarylalkane compounds is unnecessary herein. Briefly, it may be noted that the following chemical reaction equation represents one useful synthetic procedure for preparing many of the polyarylalkane compounds of formula I.

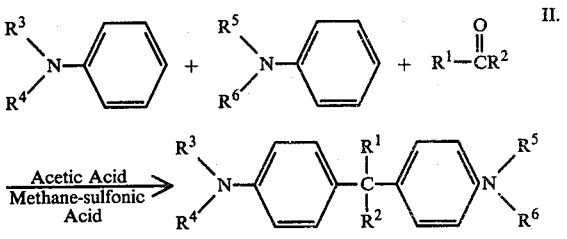

II.

wherein $R^1$, $R^2$, $R^3$, and $R^4$ are as defined hereinbefore. To further illustrate the general reaction procedure outlined in reaction formula II above, the chemical synthesis of Compound I of Table 1 is presented as follows:

In a 100 ml round-bottomed flask fitted with a water-cooled condenser with drying tube, and with a nitrogen-gas inlet, was placed a mixture of 4,4'-dimethyltriphenylamine, 20 g, cyclohexanone, 8.8 g, acetic acid, 30 mls, and methanesulfonic acid, 0.5 g. A small current of nitrogen was passed through the mixture which was heated on the steam bath. All the solid went into solution, and the liquid turned blue. The mixture was heated overnight, during which time a crystalline solid was deposited. A small portion of the solid plus supernatant liquid was removed, dissolved in benzene, washed with dilute NaOh, separated, dried over $K_2CO_3$ and examined by thin-layer chromatography using Eastman silica Chromagram ® sheet with light ligroin as eluent. It was found that the product was principally the desired compound. The whole of the remaining reaction mixture was dissolved in benzene and washed with dilute NaOH (the blue coloration turning to brown). The aqueous layer was separated off and re-extracted twice with a little benzene. The combined benzene layers were dried over $K_2CO_3$, filtered and evaporated down somewhat. Solvent loss was made up by replacement with ethanol, and crystallization was induced by seeding and scratching. The light-tan solid was filtered off and crystallized twice more from benzene-ethanol, m.p. 178.1°–181.4° C. The off-white material was taken into solution in benzene, treated hot with decolorizing charcoal, and filtered hot. The filtrate was evaporated down with replenishment of solvent with ethanol until spontaneous crystallization occurred. The white solid was filtered off and dried in a vacuum at 45° C. overnight. Yield 16.1 g, m.p. 181.4°–182.4° C.

A mass-spectrum analysis of the product revealed it to be the desired one having a molecular weight of 626.

The following examples are presented herein merely to illustrate, not to limit, the present invention.

EXAMPLE 1

Compound I of Table 1 was utilized as a photoconductor in the following three compositions.

Homogeneous Non-Aggregate Photoconductive Coating Composition I

Polyester binder (Vitel ® PE 101 purchased from Goodyear
Tire and Rubber Co.) — 1.0 g.
Compound I of Table 1 — 0.25 g.
2,6-bis(4-ethylphenyl)-4-(4-n-amyloxyphenyl)-thiapyrylium perchlorate — 0.01 g.
Dichloromethane — 9.6 g.

Homogeneous Non-Aggregate Photoconductive Coating Composition II

Polyester binder (Vitel ® PE 101) — 1.0 g.
Compound I of Table 1 — 0.25 g.
4-(n Butylamino)-2-(4-methoxyphenyl)benzo[b]-pyrylium perchlorate — 0.02 g.
Dichloromethane — 9.6 g.

Aggregate Photoconductive Coating Composition I

Lexan ® 145 (Bisphenol A polycarbonate sold by General Electric Co.) — 1.0 g.
Compound I of Table 1 — 0.25 g.
4-p Dimethylaminophenyl-2,6-diphenylthiapyrylium perchlorate — 0.025 g. (aggregated with Lexan ® 145 as described in Example 8 of U.S. Pat. No. 3,615,396).
Dichloromethane — 9.6 g.

The above-noted coating compositions were coated on a poly(ethylene terephthalate) base having an evaporated nickel conductive layer and the relative electrical speed of these compositions was measured as shown in Table 2.

The relative speed measurements reported in this and the following examples are relative H & D electrical speeds. The relative H & D electrical speeds measure the speed of a given photoconductive material relative to other materials typically within the same test group of materials. The relative speed values are not absolute speed values. However, relative speed values are related to absolute speed values. The relative electrical speed (shoulder or toe speed) is obtained simply by arbitrarily assigning a value, Ro, to one particular absolute shoulder or toe speed of one particular photoconductive material. The relative shoulder or toe speed, Rn, of any other photoconductive material, n, relative to this value, Ro, may then be calculated as follows: $Rn = (A_n)(^{Ro}/_{Ao})$ wherein An is the absolute electrical speed of material n, Ro is the speed value arbitrarily assigned to the first material, and Ao is the absolute electrical speed of the first material. The absolute H & D electrical speed, either the shoulder (SH) or toe speed, of a material may be determined as follows: The material is electrostatically charged under, for example, a corona source until the surface potential, as measured by an electrometer probe, reaches some suitable initial value $V_o$, typically about 600 volts. The charged element is then exposed to a 3000° K. tungsten light source through a stepped density gray scale. The exposure causes reduction of the surface potential of the element under each step of the gray scale from its initial potential $V_o$ to some lower potential V the exact value of which depends upon the amount of exposure in meter-candle-seconds received by the area. The results of these measurements are then plotted on a graph of surface potential V vs. log exposure for each step, thereby forming an electrical characteristic curve. The electrical or electrophotographic speed of the photoconductive composition can then be expressed in terms of the reciprocal of the exposure required to reduce the surface potential to any fixed selected value. The actual positive or negative shoulder speed is the numerical expression of $10^4$ divided by the exposure in meter-candle-seconds required to reduce the initial surface potential $V_o$ to some value equal to $V_o$ minus 100. This is referred to as the 100 volt shoulder speed. Sometimes it is desirable to determine the 50 volt shoulder speed and, in that instance, the exposure used is that required to reduce the surface potential to $V_o$ minus 50. Similarly, the actual positive or negative toe speed is the numerical expression of $10^4$ divided by the exposure in meter-candle-seconds required to reduce the initial potential $V_o$ to an absolute value of 100 volts. Again, if one wishes to determine the 50 volt toe speed, one merely uses the exposure required to reduce $V_o$ to an absolute value of 50 volts. An apparatus useful for determining the electrophotographic speeds of photoconductive compositions is described in Robinson et al, U.S. Pat. No. 3,449,658, issued June 10, 1969.

TABLE 2

| Photoconductive Compositions | Relative Electrical Speed: Positive Charging (100 volt SH/ 100 volt toe) | Relative Electrical Speed: Negative Charging (100 volt SH/ 100 volt toe) |
|---|---|---|
| Homogeneous I | 15.5/1.0* | 10/0 |
| Homogeneous II | 1.9/0 | 2.7/0 |

TABLE 2-continued

| Photoconductive Compositions | Relative Electrical Speed: Positive Charging (100 volt SH/ 100 volt toe) | Relative Electrical Speed: Negative Charging (100 volt SH/ 100 volt toe) |
|---|---|---|
| Aggregate I | 3448/345 | 1379/86 |

*Arbitrarily assigned a speed value of 1.0

EXAMPLE 2

Two aggregate photoconductor formulations of the type described in Example 1 were prepared utilizing (at 20% by weight) the control photoconductor 4,4'-bis(-diethylamino)-2,2'-dimethyltriphenylmethane in one, and in the other, the photoconductor described in Example 1 above. Each of these elements contained 2 percent by weight of 4-p-dimethylaminophenyl-2,6-diphenylthiapyrylium perchlorate aggregated with the Lexan® polycarbonate as in Example 1.

The electrophotographic sensitivity of each of these elements was determined by conventional techniques which involve low intensity, continuous exposures. It was noted that in the range of 25° C. to 105° C., the positive exposure of materials containing the photoconductor of Example 1, exhibited a gradual increase in sensitivity with increasing temperature; the element containing the control photoconductor exhibited an increase in response in the range of 25° C. to 85° C. followed by a sharp decrease in sensitivity for temperatures above 85° C. to 90° C. It thus appeared that high levels of thermal stability and radiation sensitivity, particularly for the positive charging mode, can be obtained by the incorporation of the subject photoconductor into aggregated photoconductive compositions.

EXAMPLE 3

In the course of investigating the improved heat stability provided by the organic photoconductive materials employed in the organic photoconductive compositions of the present invention (as shown in preceding Example 2) it was found, unexpectedly, that the improvement in heat stability corresponded to the relatively high glass transition temperature, Tg, possessed by the materials used in the present invention. To demonstrate the significance of the substantial differences in glass transition temperature existing between the organic photoconductive materials used in the present invention in comparison to certain known organic photoconductors having a similar molecular structure, a series of glass transition temperature measurements were performed and the following results were obtained as compiled in Table 2A below. As is apparent from Table 2A the materials used in the present invention exhibit a significantly higher glass transition temperature in comparison to the known organic photoconductors having a similar molecular structure.

The glass transition temperatures reported in this Example and elsewhere in the present specification refers to the temperature at which the particular organic photoconductive material being tested changes from a glassy or vitreous solid to a fluid material. The glass transition temperatures reported herein are determined by differential thermal analysis by placing a sample of the material to be tested in a DuPont 990 thermal analyser and heating at a rate of 20° C. per minute in a nitrogen atmosphere.

TABLE 2A

| Compound No. from Table 1 | Compound Structure | Glass Transition Temperature ($T_g$) |
|---|---|---|
| I. | 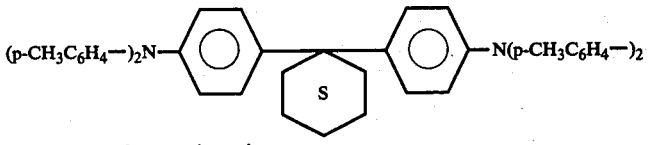 within scope of present invention | 82° C. |
| Ia. | 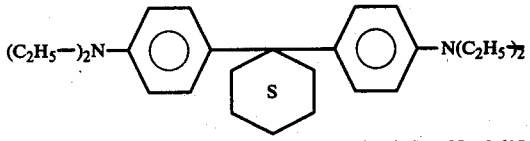 outside scope of invention, compound VII of U.S. Pat. No. 3,615,401 | −18° C. |
| Ib. | 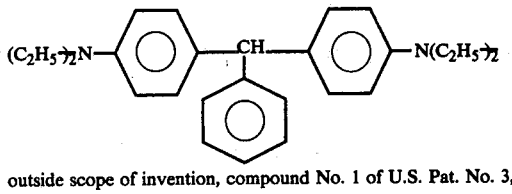 outside scope of invention, compound No. 1 of U.S. Pat. No. 3,542,547 | 7° C. |
| II. | 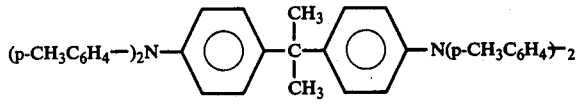 within scope of present invention | 70–72° C. |
| V. | 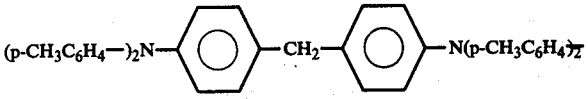 within scope of present invention | 60° C. |
| VII. | 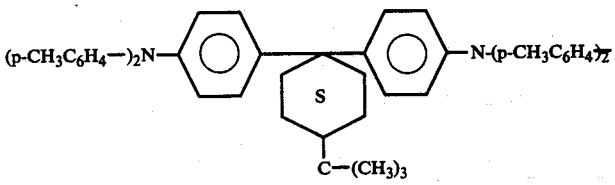 within scope of present invention | 89° C. |
| VIII. | 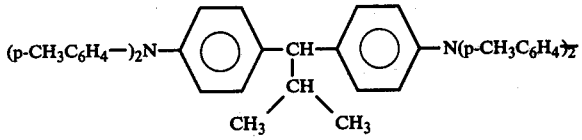 within scope of present invention | 79° C. |
| VIIIa. | 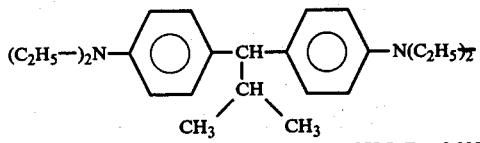 outside scope of invention, compound IX of U.S. Pat. 3,820,989 | −23° C. |
| IX | 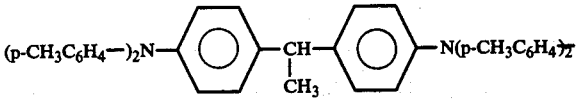 within scope of the invention | 65° C. |
| X | 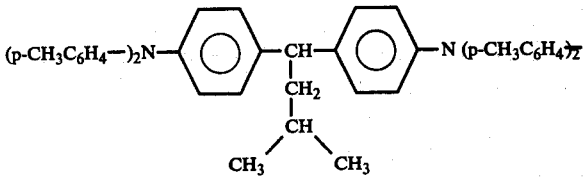 within scope of the invention | 69° C. |

EXAMPLE 4

Two aggregate photoconductor formulations of the type described in Example 1 were prepared utilizing (at 20% by weight) the control photoconductor 4,4'-tetramethyldiaminophenylmethane in one, and in the other, the photoconductor of the invention described in Example 1 above. Each of these elements contained 2 percent by weight of 4-p-dimethylaminophenyl-2,6-diphenylthiapyrylium perchlorate aggregated with the Lexan® polycarbonate as in Example 1.

The relative electrical speeds of each of these elements was determined as described in Example 2 and are noted in Table 3. As shown in Table 3, the photoconductor of the type used in the present invention generally provided an aggregate photoconductive composition exhibiting higher speeds than could be obtained when the control photoconductor, 4,4'-tetramethyldiaminophenylmethane, was substituted in the aggregate photoconductive composition.

TABLE 3

| Photoconductive Composition | Relative Electrical Speed: Positive Charging (100 volt SH/ 100 volt toe) | Relative Electrical Speed: Negative Charging (100 volt SH/ 100 volt toe |
|---|---|---|
| Aggregate Composition with control photoconductor | 11.6/1.0* | 20/4.2 |
| Aggregate Composition with photoconductor of the invention | 83.4/8.3 | 33.3/2.1 |

*Arbitrarily assigned a speed value of 1.0

EXAMPLE 5

As noted in preceding Example 3, an organic photoconductive composition having improved thermal stability can be obtained by using an organic photoconductor having a relatively high glass transition temperature. In this regard, the organic photoconductors used in the present invention have been found to possess a relatively high glass transition particularly when compared to structurally somewhat similar, prior art compounds such as N,N,N',N'-substituted-1,3-phenylenediamine and 4,4'methylene bis(N,N-dimethylaniline). For example, compounds I and II of Table I, two of the polyarylalkane compounds of the present invention, exhibit a glass transition temperature of about 82° C. and 72° C., respectively. In contrast, N,N,N',N'-tetrabenzyl-1,3-phenylenediamine, a prior art compound which is believed to be incorporated in certain commercially available electrophotographic compositions, possesses a glass transition temperature of only about 11° C. and 4,4'methylene bis(N,N-dimethylaniline) possesses a glass transition temperature of less than about 0° C.

The next two examples are presented to show the unexpected improvement in heat stability of the photoconductive compositions of the present invention compared to prior art photoconductive compositions containing organic photoconductive materials which are structurally similar to the compounds of Formula I.

EXAMPLE 6

For comparison purposes, compound 2, column 2 of U.S. Pat. No. 3,963,779 was prepared substantially according to the procedure set out in said patent. Compound 2 has the following structure:

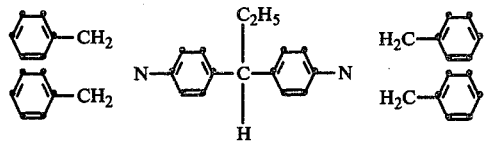

The glass transition temperature of said compound 2 was determined by differential thermal analysis and compared to the glass transition temperature of compounds I, II and VIII in Table 1 of the present application.

TABLE 3

| Compound | Source | Glass Transition Temperature ° C |
|---|---|---|
| 2 | U.S. Pat. No. 3,963,779 | 29 |
| I | Table 1 | 82 |
| II | Table 1 | 70–72 |
| VIII | Table 1 | 79 |

For comparison purposes, two photoconductive elements were prepared and coated as in Example 1 as follows:

Photoconductive Element I consisted of a photoconductive composition comprising 1.0 g of Lexan polycarbonate; 0.25 g of Compound I, Table 1 of this case; 0.01 g of 2,6 bis(4-ethylphenyl)-4-(4-n-amyloxyphenyl)thiopyrylium perchlorate and 9.6 g of dichloromethane. The latter composition was coated on a poly(ethylene terephthalate) base having an evaporated nickel conducting layer.

Photoconductive Element II was the same as photoconductive Element I, except 0.25 g of Compound 2, Column 2, of U.S. Pat. No. 3,963,779 was substituted for said Compound I.

Then the electrophotographic sensitivity of each of said elements was determined as in Example 2. As a result of measuring the electrophotographic sensitivity of each element, it was observed that in the range of 25° C. to 90° C., photoconductive Element I exhibits increasing sensitivity with increasing temperature. The electrophotographic sensitivity of photoconductive Element II increased in the range of 25° C. to 60° C. However, about 60° C. the sensitivity of photoconductive Element II decreased.

EXAMPLE 7

Compound 4, column 2 of U.S. Pat. 3,963,779 was prepared substantially according to the procedure described in said patent. Compound 4 had the following structure:

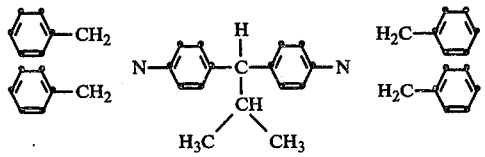

Compound 4
(U.S. Pat. No. 3,963,779)

The glass transition temperature of compound 4 and the heat stability of photoconductive compositions containing said compound 4 were compared to the glass transition temperature of Compound VIII of the present application and the heat stability of photoconductive composition containing said Compound VIII.

| Compound | Source | Glass Transition Temperature ° C |
|---|---|---|
| 4 | U.S. Pat. No. 3,963,779 | 39° C |
| VIII | Table 1 | 79° C |

Two photoconductive elements were prepared as in Example 6. The composition of the elements were the same as in Example 6 except photoconductive element I contained Compound VIII, from Table 1 instead of Compound I from Table 1 and photoconductive element II contained compound 4 from U.S. Pat. No. 3,963,779 instead of compound 2 from U.S. Pat. No. 3,963,779.

The relative electrical speed of each element was determined in accordance with Example 1. Each element was charged to a surface potential of 250 volts. Each of the charged elements were then exposed at various temperatures until the surface potential decreased to 125 volts. The following results were obtained:

TABLE 4

| Element | Compound | Relative Electrical Speed | | | | |
|---|---|---|---|---|---|---|
| | | 70° C | 80° C | 90° C | 100° C | 110° C |
| I | VIII (Table 1) | 0.94 | 1.0* | 1.03 | 1.03 | 1.03 |
| II | 4(U.S. Pat. No. 3,963,779) | 0.29 | 0.30 | 0.28 | 0.25 | .21 |

*Arbitrarily assigned a value of 1.0

Table 4 shows that Compound VIII increases the electrical speed of Element I in the range of 70° C. to 90° C. and maintains the increased speed up to at least 110° C. Compound 4, on the other hand had a much lower speed which decreases after about 80° C.

The data of Examples 6 and 7 show that the compounds of the present invention are extremely useful in improving the thermal stability of photoconductive compositions at relatively high temperatures while structurally related compounds do not impart this improvement to photoconductive compositions.

The invention has been described in detail with reference to certain preferred embodiments thereof, but it will be understood that variations and modifications can be effected within the spirit and scope of the invention.

We claim:

1. An organic photoconductive insulating composition comprising an electrically insulating polymeric binder and an organic photoconductive compound having the formula

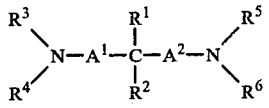

wherein $R^1$ and $R^2$, which may be the same or different, represent, when taken separately, (i) hydrogen, (ii) an unsubstituted alkyl group or substituted alkyl group having 1 to about 18 carbon atoms, said substituted alkyl having a substituent selected from the group consisting of alkoxy, aryloxy, amino, hydroxy, aryl, alkylamino, arylamino, nitro, cyano, halogen, and acyl or (iii) when taken together $R^1$ and $R^2$ represent the saturated carbon atoms necessary to complete a cycloalkyl ring having 3 to 10 carbon atoms in the cycloalkyl ring, $R^3$, $R^4$, $R^5$ and $R^6$, which may be the same or different, each represent an unsubstituted or substituted aryl group having a substituent selected from the group consisting of alkyloxy, aryloxy, amino, hydroxy, alkylamino, arylamino, nitro, cyano, halogen, alkyl, and acyl; and $A^1$ and $A^2$, which may be the same or different, represent an unsubstituted phenyl group or a substituted phenyl having the substituents defined for $R^3$, $R^4$, $R^5$ and $R^6$ above.

2. A photoconductive composition as described in claim 1 wherein said composition contains an amount of sensitizer effective to sensitize said composition.

3. An organic photoconductive insulating composition comprising an electrically insulating polymeric binder, an organic photoconductive compound, and an amount of sensitizer effective to sensitize said composition, said photoconductive compound having the formula

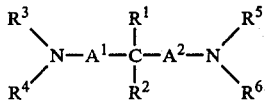

wherein $R^1$ and $R^2$, which may be the same or different, represent, when taken separately, (i) hydrogen, (ii) an unsubstituted alkyl group or substituted alkyl group having 1 to about 18 carbon atoms, said substituted alkyl having a substituent selected from the group consisting of alkoxy, aryloxy, amino, hydroxy, aryl, alkylamino, arylamino, nitro, cyano, halogen, and acyl or (iii) when taken together, $R^1$ and $R^2$ represent the saturated carbon atoms necessary to complete a cycloalkyl ring having 3 to 10 carbon atoms in the cycloalkyl ring, $R^3$, $R^4$, $R^5$, and $R^6$, which may be the same or different, each represent an unsubstituted or substituted aryl group having a substituent selected from the group consisting of alkyloxy, aryloxy, amino, hydroxy, alkylamino, arylamino, nitro, cyano, halogen, alkyl, and acyl; and $A^1$ and $A^2$, which may be the same or different, represent an unsubstituted phenyl group or a substituted phenyl group having the substituents defined for $R^3$, $R^4$, $R^5$ and $R^6$ above.

4. A photoconductive composition as defined in claim 3 wherein $R^1$ and $R^2$, taken together, represent the saturated carbon atoms necessary to complete a 6-member cycloalkyl ring and $A^1$ and $A^2$ represent unsubstituted phenyl groups.

5. A photoconductive composition as defined in claim 3 wherein $R^3$, $R^4$, $R^5$, and $R^6$ each represent unsubstituted phenyl groups or alkyl substituted phenyl groups and $A^1$ and $A^2$ represent unsubstituted phenyl groups.

6. A photoconductive composition as defined in claim 3 wherein said sensitizer is present in an amount of from about 0.005 to about 10 percent by weight of said composition and said organic photoconductive compound is present in an amount of from about 15 to about 90 percent by weight of said composition.

7. A photoconductive composition as defined in claim 3 wherein said composition is a homogeneous composition having said organic photoconductive compound in solid solution with said polymeric binder.

8. An organic, homogeneous, photoconductive insulating composition comprising an electrically insulating polymeric binder, an organic photoconductive compound in an amount equal to at least about 15 percent by weight of said composition, and a sensitizer for said composition in an amount within the range of from about 0.005 to about 10 percent by weight of said composition, said organic photoconductive compound in solid solution with said binder and having the formula

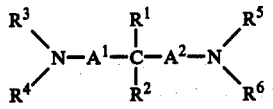

wherein $R^1$ and $R^2$, which may be the same or different, represent, when taken separately, (i) hydrogen, (ii) an unsubstituted alkyl group or substituted alkyl group having 1 to about 18 carbon atoms, said substituted alkyl having a substituent selected from the group consisting of alkoxy, aryloxy, amino, hydroxy, aryl, alkylamino, arylamino, nitro, cyano, halogen, and acyl or (iii) when taken together, $R^1$ and $R^2$ represent the saturated carbon atoms necessary to complete a cycloalkyl group having 5 to 7 carbon atoms in the cycloalkyl ring, $R^3$, $R^4$, $R^5$, and $R^6$, which may be the same or different, each represent an unsubstituted or substituted aryl group having a substituent selected from the group consisting of alkyloxy, aryloxy, amino, hydroxy, alkylamino, arylamino, nitro, cyano, halogen, alkyl, and acyl; and $A^1$ and $A^2$, which may be the same or different, represent an unsubstituted phenyl group or a substituted phenyl group having the substituents defined for $R^3$, $R^4$, $R^5$ and $R^6$ above.

9. A homogeneous photoconductive composition as defined in claim 8 wherein said organic photoconductive compound is selected from the group consisting of 1,1-Bis(4-di-p-tolylaminophenyl)cyclohexane; 2,2-Bis(-di-p-tolylaminophenyl)propane; 4,4'-Bis(di-p-tolylamino)-1,1,1-triphenylethane; 4,4'-bis(di-p-tolylamino)tetraphenylmethane; bis(4-di-p-tolylaminophenyl)methane; bis(4-di-p-tolylaminophenyl)-phenylmethane; 1,1-bis(4-di-p-tolylaminophenyl)-4-t-butylcyclohexane; 1,1-bis(4-di-p-tolylaminophenyl)-2-methylpropane; 1,1-bis(4-di-p-tolylaminophenyl)ethane; and 1,1-bis(4-di-p-tolylaminophenyl)-3-methylbutane.

10. An organic, aggregate, photoconductive insulating composition comprising a continuous, electrically insulating binder phase containing (a) dissolved therein one or more photoconductive compounds and (b) dispersed therein a particulate co-crystalline complex of (1) a dye salt selected from the group consisting of pyrylium, thiapyrylium, and selenapyrylium dye salts and (2) a polymer having an alkylidene diarylene moiety in a recurring unit thereof, at least one of said photoconductors having the formula

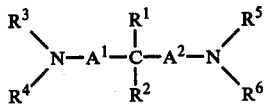

wherein $R^1$ and $R^2$, which may be the same or different, represent, when taken separately, (i) hydrogen, (ii) an unsubstituted alkyl group or substituted alkyl group having 1 to about 18 carbon atoms, said substituted alkyl having a substituent selected from the group consisting of alkoxy, aryloxy, amino, hydroxy, aryl, alkylamino, arylamino, nitro, cyano, halogen, and acyl or (iii) when taken together, $R^1$ and $R^2$ represent the saturated carbon atoms necessary to complete a cycloalkyl ring having 3 to 10 carbon atoms in the cycloalkyl ring, $R^3$, $R^4$, $R^5$, and $R^6$, which may be the same or different, each represent an unsubstituted or substituted aryl group as defined above for $R^1$ and $R^2$, and $A^1$ and $A^2$, which may be the same or different, represent an unsubstituted phenyl group or a substituted phenyl group having the substituents defined for $R^3$, $R^4$, $R^5$ and $R^6$ above.

11. An aggregate photoconductive composition as defined in claim 10 wherein said dye salt is a 2,4,6-substituted thiapyrylium dye salt, $A^1$ and $A^2$ represent unsubstituted phenyl groups, and $R^3$, $R^4$, $R^5$ and $R^6$ each represent an unsubstituted phenyl or an alkyl substituted phenyl group.

12. An organic, aggregate, photoconductive insulating composition comprising a continuous, electrically insulating binder phase containing (a) dissolved therein one or more photoconductive compounds and (b) dispersed therein a particulate co-crystalline complex of (1) a thispyrylium dye salt and (2) a carbonate polymer having a alkylidene diarylene moiety in a recurring unit thereof, at least one of said photoconductors having the formula

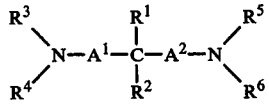

wherein $R^1$ and $R^2$, which may be the same or different, represent, when taken separately, (i) hydrogen, (ii) an unsubstituted alkyl group or substituted alkyl group having 1 to about 18 carbon atoms, said substituted alkyl having a substituent selected from the group consisting of alkoxy, aryloxy, amino, hydroxy, aryl, alkylamino, arylamino, nitro, cyano, halogen, and acyl or (iii) when taken together, $R^1$ and $R^2$ represent the saturated carbon atoms necessary to complete a cycloalkyl ring having 5 to 7 carbon atoms in the cycloalkyl ring, $R^3$, $R^4$, $R^5$, and $R^6$, which may be the same or different, each represent an unsubstituted or substituted aryl group having a substituent selected from the group consisting of alkyloxy, aryloxy, amino, hydroxy, alkylamino, arylamino, nitro, cyano, halogen, alkyl, and acyl; and $A^1$ and $A^2$, which may be the same or different, represent an unsubstituted phenyl group or a substituted phenyl group having the substituents defined for $R^3$, $R^4$, $R^5$ and $R^6$ above.

13. An aggregate photoconductive composition as defined in claim 12 wherein $R^1$ and $R^2$, taken together, represent the saturated carbon atoms necessary to complete a 6-member cycloalkyl ring and $A^1$ and $A^2$ represent unsubstituted phenyl groups.

14. An aggregate photoconductive composition as defined in claim 12 wherein $R^3$, $R^4$, $R^5$, and $R^6$ each represent an unsubstituted phenyl group or an alkyl-substituted phenyl group, and $A^1$ and $A^2$ represent unsubstituted phenyl groups.

15. An aggregate photoconductive composition as defined in claim 12 wherein at least one of said photoconductors is selected from the group consisting of 1,1-bis(4-di-p-tolylaminophenyl)cyclohexane; 2,2-bis(-di-p-tolylaminophenyl)propane; 4,4'-bis(di-p-tolylamino)-1,1,1-triphenylethane; 4,4'-bis(di-p-tolylamino)tetraphenylmethane; bis(4-di-p-tolylamino-phenyl)-phenylmethane; 1,1-bis(4-di-p-tolylamino-phenyl)-4-t-butyl-cyclohexane; 1,1-bis(4-di-p-tolylaminophenyl)-2-methylpropane; 1,1-bis(4-di-p-tolylaminophenyl)ethane; and 1,1-bis(4-di-p-tolylaminophenyl)-3-methylbutane.

16. An aggregate photoconductive composition as defined in claim 12 wherein at least one of said photoconductors is 1,1-bis(4-di-p-tolylaminophenyl)cyclohexane.

17. In an electrophotographic element comprising a conductive support bearing an organic, photoconductive insulating layer, the improvement wherein said organic photoconductive insulating layer comprises the photoconductive composition of claim 1.

18. In an electrophotographic element comprising a conductive support bearing an organic, photoconductive insulating layer, the improvement wherein said organic, photoconductive insulating layer comprises the photoconductive composition of claim 10.

19. In an electrophotographic process wherein an electrostatic charge pattern is formed on a photoconductive element comprised of an electrically conducting support bearing a layer of an organic, photoconductive insulating composition, the improvement wherein said organic, photoconductive insulating composition comprises an electrically insulating polymeric binder and an organic photoconductive compound having the formula

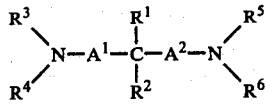

wherein $R^1$ and $R^2$, which may be the same or different, represent, when taken separately, (i) hydrogen, (ii) an unsubstituted alkyl group or substituted alkyl group having 1 to about 18 carbon atoms, said substituted alkyl having a substituent selected from the group consisting of alkoxy, aryloxy, amino, hydroxy, aryl, alkylamino, arylamino, nitro, cyano, halogen, and acyl or (iii) when taken together, $R^1$ and $R^2$ represent the saturated carbon atoms necessary to complete a cycloalkyl ring having 3 to 10 carbon atoms in the cycloalkyl ring, $R^3$, $R^4$, $R^5$, and $R^6$, which may be the same or different, each represent an unsubstituted or substituted aryl group having a substituent selected from the group consisting of alkyloxy, aryloxy, amino, hydroxy, alkylamino, arylamino, nitro, cyano, halogen, alkyl, and acyl; and $A^1$ an $A^2$, which may be the same or different, represent an unsubstituted phenyl group or a substituted phenyl group having the substituents defined for $R^3$, $R^4$, $R^5$ and $R^6$ above.

* * * * *

UNITED STATES PATENT AND TRADEMARK OFFICE

CERTIFICATE OF CORRECTION

PATENT NO. : 4,127,412

DATED : November 28, 1978

INVENTOR(S) : Rule et al

It is certified that error appears in the above-identified patent and that said Letters Patent are hereby corrected as shown below:

Title page, item [63], line 3, "1976" should read --1974--. Column 5, line 65, that part of the formula reading "$CH_3H_4$" should read --$CH_3C_6H_4$--. Column 7, line 46, "hetergeneity" should read --heterogeneity--. Column 10, line 11, that part of the formula reading "2,3" should read --1,3--; line 16, that part of the formula reading "carbonylidiphenylene" should read --carbonyldiphenylene--; line 21, that part of the formula reading "sulfonylidiphenylene" should read --sulfonyldiphenylene--; line 23, that part of the formula reading "isipropylidenebis" should read --isopropylidenebis--; line 34, that part of the formula reading "[4,4'" should read --poly[4,4'--. Columns 19-20, under heading Compound Structure, line 4, "3,615,401" should read --3,615,402--. Column 22, columnar lines 3-5, the formula reading:

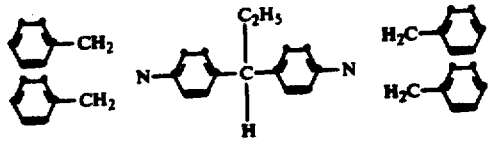

should read

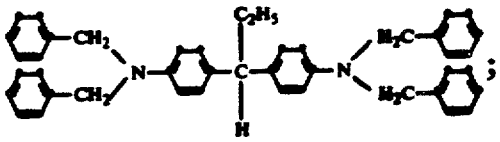

line 45, "about" should read --above--; columnar lines 55-58, the formula reading:

UNITED STATES PATENT AND TRADEMARK OFFICE

CERTIFICATE OF CORRECTION

PATENT NO. : 4,127,412

DATED : November 28, 1978

INVENTOR(S) : Rule et al

It is certified that error appears in the above-identified patent and that said Letters Patent are hereby corrected as shown below:

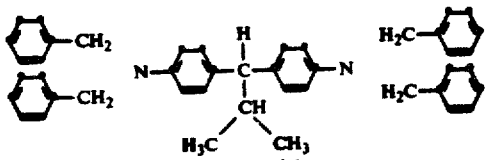

Compound 4
(U.S. Pat. No. 3,963,779)

should read

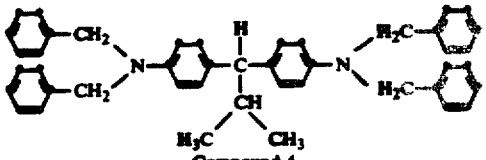

Compound 4
(U.S. Pat. No. 3,963,779)

Column 26, line 31, "thispyrlium" should read --thiapyrlium--; lines 61-63 should be indented to the right of the beginning line (60) of the paragraph so as to conform with the manner in which the two preceding paragraphs were set up by the printer.

Signed and Sealed this

*Twentieth* Day of *November 1979*

[SEAL]

*Attest:*

RUTH C. MASON
*Attesting Officer*

LUTRELLE F. PARKER
*Acting Commissioner of Patents and Trademarks*